US008435644B2

(12) United States Patent
Dobesberger et al.

(10) Patent No.: US 8,435,644 B2
(45) Date of Patent: May 7, 2013

(54) METAL MOULDING AND METHOD FOR PRODUCING IT

(75) Inventors: Franz Dobesberger, Schwarzenau (AT); Herbert J. Flankl, Perg (AT); Dietmar Leitlmeier, Schleissheim/Wels (AT)

(73) Assignee: Huette Klein-Reichenbach Gesellschaft m.b.H, Schwarzenau (AT)

( * ) Notice: Subject to any disclaimer, the term of this patent is extended or adjusted under 35 U.S.C. 154(b) by 1100 days.

(21) Appl. No.: 12/305,889

(22) PCT Filed: Jul. 2, 2007

(86) PCT No.: PCT/AT2007/000326

§ 371 (c)(1),
(2), (4) Date: Dec. 19, 2008

(87) PCT Pub. No.: WO2008/006122

PCT Pub. Date: Jan. 17, 2008

(65) Prior Publication Data

US 2010/0190028 A1 Jul. 29, 2010

(30) Foreign Application Priority Data

Jul. 13, 2006 (AT) ..... 1189/2006

(51) Int. Cl.
*B32B 5/18* (2006.01)

(52) U.S. Cl.
USPC ..... 428/613; 428/614

(58) Field of Classification Search ..... None
See application file for complete search history.

(56) References Cited

U.S. PATENT DOCUMENTS

| | | | | |
|---|---|---|---|---|
| 7,137,433 | B2 * | 11/2006 | Dobesberger et al. | 164/23 |
| 2002/0127425 | A1 * | 9/2002 | Wolfsgruber et al. | 428/613 |
| 2003/0051850 | A1 | 3/2003 | Asholt et al. | |
| 2003/0198827 | A1 | 10/2003 | Dobesberger et al. | |
| 2006/0029826 | A1 | 2/2006 | Dobesberger et al. | |

FOREIGN PATENT DOCUMENTS

| | | | |
|---|---|---|---|
| AT | 408317 | B | 10/2001 |
| AT | 410103 | B | 2/2003 |
| AT | 410104 | B | 2/2003 |
| AT | 411768 | B | 5/2004 |
| AT | 411970 | B | 8/2004 |
| DE | 19811612 | C1 | 2/1999 |

(Continued)

OTHER PUBLICATIONS

Jefferson Lab, "It's Elemental—The Element Aluminum", http://education.jlab.org/itselemental/ele013.html, 2005, Accessed Jan. 24, 2012.*

(Continued)

*Primary Examiner* — Jennifer McNeil
*Assistant Examiner* — Daniel J Schleis
(74) *Attorney, Agent, or Firm* — Greenblum & Bernstein, P.L.C.

(57) ABSTRACT

A metal molding (10) comprises a metal foam region (12) composed of a metal foam consisting of a metal, a further region (14) in which the metal has fewer or smaller cavities than in the metal foam region, and an essentially sheet-like one-part or multipart insert element (16) with orifices or interspaces. The insert element (16) is arranged in a fringe region between the metal foam region (12) and the further region (14). The metal in the further region (14) is connected metallically to the metal in the metal foam region (12) in orifices or interspaces of the insert element (16).

15 Claims, 4 Drawing Sheets

FOREIGN PATENT DOCUMENTS

| | | | |
|---|---|---|---|
| DE | 19908867 | A1 | 9/2000 |
| DE | 10127716 | A1 | 12/2002 |
| EP | 0764489 | A1 | 3/1997 |
| EP | 1354651 | A | 10/2003 |
| WO | 00/32335 | A1 | 6/2000 |
| WO | 2004/087981 | A2 | 10/2004 |

OTHER PUBLICATIONS

Simancik F et al. "Reinforced Aluminium Foams" Cellular Metals and Metal Foaming Technology, 2001, pp. 365-368, XP009034575.

Kretz R et al.: "Fabrication of Squeeze Castings with Permanent Aluminium Foam Cores" Proceedings of the European conference on advanced materials and processes, DGM Informationsgesellschaft Verlag, Oberursel, DE, 1999, pp. 63-67, XP009027703.

Simancik et al., "Complex Foamed Aluminum Parts as Permanent Cores in Aluminum Castings," *Materials Research Society Symposium Proceedings*, vol. 521, XP009027703, pp. 151-157 (1998).

* cited by examiner

METAL MOULDING AND METHOD FOR PRODUCING IT

CROSS-REFERENCE TO RELATED APPLICATIONS

The present application is a U.S. National Stage of International Patent Application No. PCT/AT2007/000326 filed Jul. 2, 2007 which published as WO 2008/006122 on Jan. 17, 2008, and claims priority of Austrian Patent Application No. A 1189/2006 filed Jul. 13, 2006.

BACKGROUND OF THE INVENTION

1. Field of the Invention

The present invention relates to a metal molding having metallically connected regions of metal foam, on the one hand, and metal, on the other hand, and of at least one insert element made of material having a higher melting point than the basic material of foam and metal, and also to a method for producing it.

2. Discussion of Background Information

Lightweight metal moldings and production methods of the type mentioned are known, for example, from AT 408317 B, according to which, in a powder-metallurgic method, a semifinished product body consisting of a compacted mixture of a matrix metal powder and of a propellant powder is heated in a foaming mold, together with at least one insert element, to a temperature at which the matrix metal powder melts and releases the propellant powder which forms gas bubbles in the matrix metal. The metal foam occurring envelopes the insert element which consists of material not melting at the temperatures used and which can fulfill the most diverse possible functions, such as, for example, the provision of connections, cavities, reinforcements and the like. Disadvantages of such metal moldings and of the production method are to be seen in the high outlay involved, along with the resulting costs, and, in particular, also in the division, controllable only with difficulty or even not at all, of the metal foam regions and metal regions, and in the broad distribution of the pore size in the metal foam itself, all this having adverse influences on the quality of the moldings.

In likewise known fusion-metallurgy methods for the production of metal foam itself (see, for example, AT 410103 B or AT 411970 B), gas is introduced into a metal melt reinforced with particles, the result of which the gas bubbles formed collect on the surface of the melt, thereby producing flowable metal foam. This metal foam then either is cast or pressed into a mold or can also rise directly into a mold arranged above the melt. The foaming gas in this case introduced into the melt by means of nozzles (see, for example AT 410104 B or AT 411768 B) or by means of what is known as an impeller (see, for example US 2003/0051850 A1). Metal foam is in this case produced predominantly from aluminum composite material, but additionally also from composites of magnesium or other light metals. The most comprehensive industrial experience has hitherto been based on aluminum foam which, from the point of view of the desired minimum mass density, is virtually ideal and also has outstanding properties in terms of energy absorption. Moldings consisting of metal foam are therefore used, for example, in the crumple zone of automobiles, as cavity reinforcements, but also as lost core parts of lightweight hollow castings reinforced thereby, said moldings additionally having a positive influence on solid-borne sound properties.

However, metal foam and moldings produced from it are capable to only a relatively small extent of absorbing tensile stresses, and attempts have already been made to improve this by means of the insert elements referred to initially. Further, there has also hitherto been an unsatisfactory outcome of attempts to provide any desired thickness or configuration of a solid, high-density and relatively foam-free outer wall region.

SUMMARY OF THE INVENTION

The present invention relates to a metal molding and a method of the type initially mentioned, such that the possibilities afforded by the functional insert elements can be utilized optimally, and such that even a solid foam-free outer wall region consisting of metal, with any desired configuration within broad limits, becomes possible.

According to the present invention, in the case of a metal molding of the type initially mentioned, this object is achieved in that the metal foam region/metal foam regions consists/consist (in each case) of metal foam with an essentially monomodal bubble size and are delimited with respect to adjacent regions, at least partially, by way of insert elements which are arranged in the fringe region and which are of essentially sheet-like design and have through orifices from one region to the other which are designed in terms of their cross section such that the essentially monomodal foam bubbles of one region are prevented from passing through into the other region.

The production method according to the invention for a metal molding of this type is characterized by the following steps:

Provision of a mold for the metal molding;

arrangement of at least one one-part or multipart insert element, with orifices or interspaces, in the mold in at least one fringe region between at least one metal foam region to be filled with metal foam and at least one further region;

fusion of a metal;

introduction of gas into the fused metal in order to foam the fused metal, a flowable metal foam with an essentially monomodal bubble size larger than the orifices in the insert element being obtained;

introduction of the flowable metal foam to the metal foam region and of essentially bubble-free metal into the further region; and cooling of the metal in the mold, the metal solidifying, in order to form the metal molding.

A casting according to the invention, which contains a metal molding of this type in the form of a lost core, is likewise part of the invention.

The present invention is based on the idea of arranging an insert element or a plurality of insert elements in a metal molding, in which case each insert element may be one-part or multipart and is preferably essentially sheet-like, but not necessarily planar. This insert element or these insert elements have a melting point which lies above the maximum temperature reached during the production of the metal molding and preferably contains steel, another metal or another alloy or else ceramic or other materials, in particular fiber materials consisting of carbon, glass, siliconcarbide, aluminum oxide or other ceramic fibers. Furthermore, an insert element may consist of an aluminum alloy or contain aluminum, and it preferably has coated or sized surfaces and/or an aluminum alloy with a melting point which is higher than the maximum temperature reached during the production of the metal molding.

An insert element is preferably a net, a lattice, a perforated sheet-like element, in particular a perforated metal sheet, or a wire or fiber braiding or consists of a plurality of essentially parallel straight or curved bars. It has orifices or interspaces, the shape and/or size of which are/is selected such that the liquid metal, but essentially no foam or no gas bubbles of the latter can pass through the orifices or interspaces. The insert element therefore forms a boundary between a metal foam region and a further region in which the metal has fewer or smaller or essentially no cavities.

The metal foam region is in this case preferably arranged inside the metal molding, while the further region forms the solid foam-free surface of the metal molding. Through the orifices or interspaces of the insert element, the metal in the metal foam region and the metal in the further region are connected metallically to one another, that is to say they form a continuous or one-piece crystal structure, without an oxide, adhesive or other layer, which consists of another material, lying between them.

By virtue of the configuration and arrangement of the insert element or insert elements, the shape and, in particular, the thickness of the further region and of the solid wall region can be set as desired. The insert element defines the boundary between the metal foam region and the further region and is consequently arranged in the fringe region between these.

Furthermore, the insert element is also capable of absorbing tensile stresses and consequently of fulfilling a similar task to that of reinforcing steel in reinforced concrete. For this purpose, it can be prestressed mechanically. This prestress may be generated by way of suitable tensioning devices even in the mold before the introduction of the flowable metal foam or before the cooling of the metal. Alternatively, the prestress arises in that the insert element consists of a material which has another, preferably higher coefficient of thermal expansion than the metal in the metal foam region and in the further region. In any event, a corresponding compressive stress of the metal foam region and of the solid wall region runs counter to the tensile stress in the insert element.

The invention also provides for a metal molding comprising first and second regions metallically connected to one another. The first region comprises a metal foam having a monomodal bubble size. The second region comprises a metal. At least one insert element is made of a metal material having a higher melting point than a material of the metal foam and the metal, and is arranged between and adjacent the first and second regions. The at least one insert element has essentially the form of a sheet with through orifices extending between the first and second regions. The through orifices comprise a cross section sized and configured to prevent passage of the monomodal foam bubbles of the first region from passing into the second region. An area of the second region arranged adjacent the at least one insert element contains no foam bubbles.

In embodiments, the second region is a solid metal region arranged outside of the first region.

In embodiments, the at least one insert element comprises plural insert elements.

In embodiments, the at least one insert element comprises at least one of: a net; a lattice; a perforated metal sheet; a plurality of essential parallel bars; a braided wire structure; a web; a strip; a frame; and a portion of web, strip, or frame.

In embodiments, one of the material of the first region is an aluminum composite material and the material of the at least one insert element contains steel, aluminum, ceramic, carbon or glass in one of solid form and fiber; and the material of the second region is an aluminum composite material and the material of the at least one insert element contains steel, aluminum, ceramic, carbon or glass in one of solid form and fiber.

In embodiments, one of: the metal molding comprises an outer contour and parts of at least a portion of the at least one insert element are spaced from the outer contour by an essentially identical distance; and the metal molding comprises an outer contour and the second region is arranged between the at least one insert element and the outer contour.

In embodiments, one of: the second region has essentially no foam bubbles; and at least a portion of the second region has essentially a constant thickness.

In embodiments, the least one insert element separates the first region from a third region made of metal foam, and the first and third regions one of: are different from one another in at least one property; and have different bubble size.

In embodiments, the least one insert element comprises another insert element separating the first region from a third region made of metal foam, and the first and third regions one of: are different from one another in at least one property; and have different bubble size.

In embodiments, the least one insert element is structured and arranged to increase a mechanical strength or rigidity of the metal molding.

In embodiments, the at least one insert element is mechanically pre-stressed.

In embodiments, one of the material of the first region and of the at least one insert element have different coefficients of thermal expansion; and the at least one insert element is pre-stressed via one of: a cooling of the metal molding; post-production; and via different coefficients of thermal expansion.

The invention also provides for a casting comprising a core part, an outer wall body which at least partially surrounds the core part, and said core part comprising the metal molding of the type described above.

The invention also provides for a molded part comprising first and second regions metallically connected to one another. The first region comprises a metal foam having a monomodal bubble size. The second region comprises a metal. At least one insert element made of a metal material having a higher melting point than a material of the metal foam and the metal is utilized, and is arranged between and adjacent the first and second regions. The at least one insert element has essentially the form of a sheet with through orifices extending between the first and second regions. The through orifices comprise a cross section sized and configured to prevent passage of the monomodal foam bubbles of the first region from passing into the second region.

In embodiments, an area of the second region arranged adjacent the at least one insert element is a solid metal that contains no foam bubbles.

The invention also provides for a method for producing a metal molding, comprising arrangement at least part of at least one insert element having orifices in a mold and in a region between a metal foam receiving region and another region, forming a flowable metal foam with essentially monomodal bubble size larger than the orifices in the at least one insert element, and introducing the flowable metal foam into the mold, wherein, after the introducing, the metal foam receiving region includes metal foam arranged on one side of the at least one insert element and the other region includes metal essentially without gas bubbles on an opposite side of the at least one insert element.

In embodiments, the method further comprising one of: cooling the metal in the mold; and allowing the metal to solidify.

In embodiments, the forming comprises introducing gas into a fused metal in order to form the fused metal into the flowable metal foam.

The invention also provides for a method for producing a metal molding utilizing a mold having an infeed orifice and at least one smaller orifice arranged in a vertically highest region, wherein the method comprises arranging at least one insert element in the mold, placing the mold in sealing engagement with a cast-in or filling piece, moving a metal melt through the infeed orifice upward into the at least one smaller orifice, and introducing gas into the melt in order to foam metal foam in the melt, wherein, after the introducing, metal foam is arranged in a metal foam region on one side of the at least one insert element and metal essentially without gas bubbles is arranged on an opposite side of the at least one insert element.

In embodiments, the method further comprising one of cooling the metal in the mold and allowing the metal to solidify.

In embodiments, the cast-in or filling piece projects into the metal melt.

In embodiments, at least part of the at least one insert element is utilized to form the metal foam.

In embodiments, at least one insert element comprises: a net; a lattice; a perforated metal sheet; a plurality of essential parallel bars; a braided wire structure; a web; a strip; a frame; and a portion of web, strip, or frame.

In embodiments, the method further comprises, before the introducing, pre-stressing the at least one of the insert element.

In embodiments, the method further comprises forming another region in the mold with one of metal foam having different size bubbles; metal foam having smaller size bubbles; and a predetermined thickness.

BRIEF DESCRIPTION OF THE DRAWINGS

Preferred exemplary embodiments of the present invention are explained in more detail below, with reference to the accompanying drawings in which.

DETAILED DESCRIPTION OF THE INVENTION

Figure 1A:
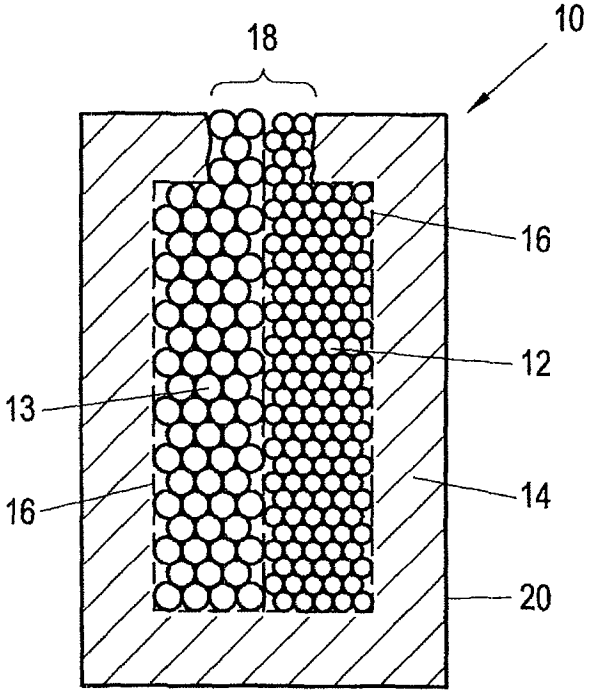
FIGS. 1 and 1*a* show in each case diagrammatic illustrations of a section through a metal molding.
Figure 1:
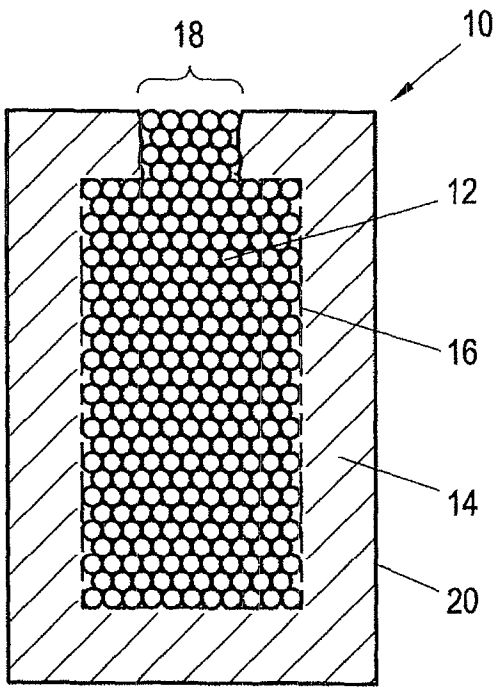

FIG. 1 is a diagrammatic illustration of a metal molding 10 with a metal foam region 12 and a solid wall region 14. An insert element 16 is arranged in the fringe region between the metal foam region 12 and the solid wall region. 14. The insert element 16 is preferably a net, lattice or braiding consisting of metal wire or metal cord, with any desired cross section, or of carbon fibers or other fibers, a perforated metal sheet or other sheet-like element or an arrangement of preferably essentially parallel bars or wires of any desired cross section. The insert element 16 preferably consists of aluminum or another material or an alloy, or of another material with a melting point which is higher than the melting point of the metal from which the metal foam region 12 and the solid wall region 14 are formed. Steel in various qualities is particularly suitable on account of its high strength, its high melting point, its good availability, its low price and the many different machining and processing possibilities. The insert element 16 may have coated or sized surfaces.

The insert element 16 has orifices or interspaces, in which the metal foam region 12 and the solid wall region 14 are directly contiguous to one another and merge homogenously one into the other. The metal foam region 12 and the solid wall region 14 are connected metallically to one another or have a continuous crystal structure, without layers, which consist of oxide or of other materials, lying between them. The metal foam region 12 and the solid wall region 14 are thus connected to one another in a materially integral manner through the orifices or interspaces of the insert element 16.

The metal foam region 12 has cavities or glass bubbles with an essentially monomodal distribution of the dimensions. This means that all or almost all cavities of the metal foam region 12 have essentially the same diameter and the same volume. The cavities are approximately in the shape of multiply flattened spheres or of polyhedra. An essentially planar or plate-shaped metal web is arranged in each case between two adjacent cavities. In the metal molding 10 illustrated in FIG. 1, the solid wall region 14 is essentially in the form of a layer which surrounds the metal foam region 12 and the insert element 16 with a constant thickness.

In a portion 18, the insert element 16 and the solid wall region 14 have an orifice or interruption, through which flowable metal foam is introduced into the metal foam region 12 when the metal molding 10 is being produced, as described below in more detail with reference to FIG. 4. In the portion 18, the metal foam region 12 is directly adjacent to the surface 20 of the metal molding 10. This may, however, be avoided by way of special measures during production or, subsequently, by milling out and closing with solid material.

The solid wall region 14 has no or essentially no cavities or at least (essentially) fewer or (essentially) smaller cavities than the metal foam region 12. Like almost any casting, however, the solid wall region 14 may also have at least isolated voids or other gas inclusions.

FIG. 1*a* differs from FIG. 1 only in that, here, two different foam regions 12, 13 are provided, which are separated from one another by an additional insert element 16 or an additional part of the multipiece insert element 16 and which contain metal foam having different properties. For the sake of clarity, different bubble sizes are illustrated here, but there could also be metal foam consisting of a different basic material, with different additives or similar differences. Here, the insert element 16 inserted between the two metal foam regions 12, 13 at the interface essentially prevents an intermixing of the two types of foam, with the result that different properties of the metal molding 10 can be predetermined in the two regions 12, 13. In the version according to FIG. 1*a*, too, the metal foam regions 12, 13 are connected metallically to one another, and these are so connected to the metal region 14, through the insert elements 16 or the parts of the insert element 16, and therefore a reinforced metal molding 10 is obtained by way of the insert elements 16.

Apart from the fact that the regions 12, 13 and 14 consist of the same basic material and differ from one another essentially only in that there are virtually no gas bubbles in the region 14, many small gas bubbles in the region 13 and fewer large gas bubbles in the region 12 (as illustrated in FIG. 1*a*), these differences could, however, also go so far that the basic materials in the regions 12, 13 and 14 differ from one another, for example different aluminum alloys could be used in the individual regions or different additives could be used in order to give the foam regions or the metal region specific desired properties.

Figure 2:
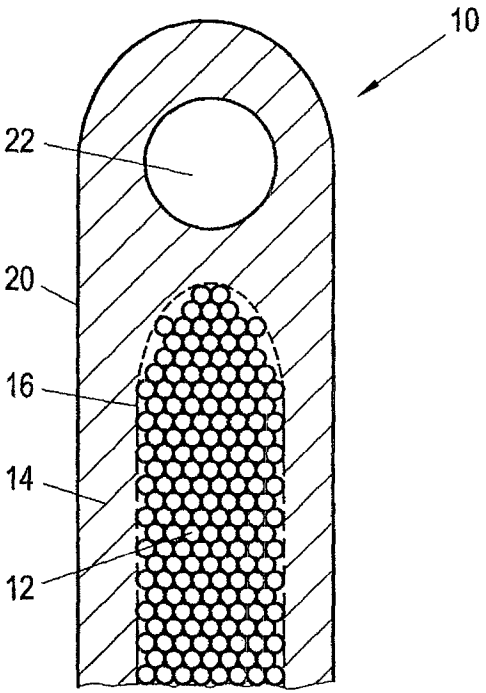
FIG. 2 shows a diagrammatic illustration of a section through a further metal molding.

FIG. 2 is a diagrammatic illustration of a portion of a further metal molding 10 with a metal foam region 12 and with a solid wall region 14 which are separated from one another by an insert element 16. The example from FIG. 2 differs from that of FIG. 1, inter alia, in that, due to the form of the insert element 16, the solid wall region 14 deviates from a single layer having a constant thickness. A lug 22 is arranged in the solid wall region 14 at one end of the metal molding 10. The form and arrangement of the lug 22 are defined by the mold used for producing the metal molding 10 or, for example, by a bush inserted into the mold. Alternatively, the lug 22 is produced, after the casting operation, on the cooled metal molding 10 by drilling or milling. The insert element 16, in the region of the lug 22, is at a greatly increased distance from the surface 20 of the metal molding 10. In the solid wall region 14, therefore, sufficient space remains for the lug 22. The form and arrangement of the insert element 16 ensure that the lug 22 is surrounded on all sides by solid material in the required thickness. Furthermore, the insert element 16 is formed and arranged such that the solid wall region 14 is reinforced toward the end and toward the lug 22 according to the increased local mechanical stresses arising there.

Figure 3:
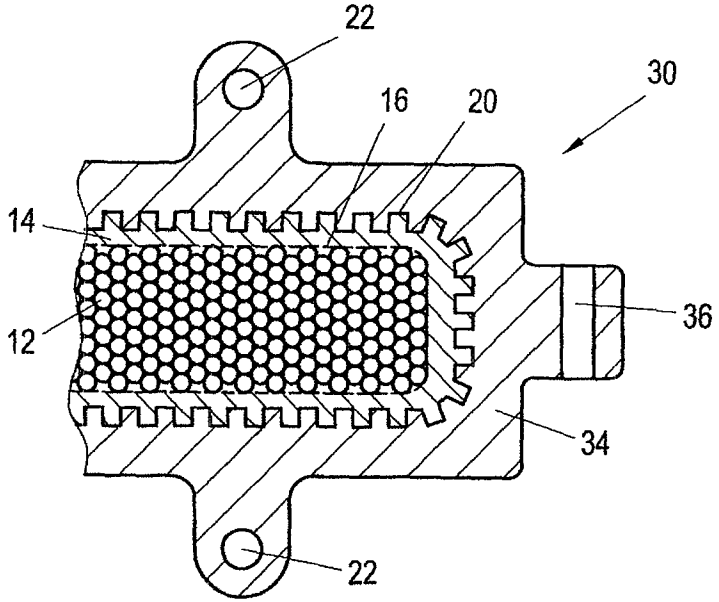
FIG. 3 shows a diagrammatic illustration of a section through a further metal molding.

FIG. 3 is a diagrammatic illustration of a section through a casting 30 with an outer wall body 34. The outer wall body 34 has a form and material thickness which conform to the intended application. For example, here, lugs 22 and a bore 36 are illustrated. In the outer wall body 34, a core part is arranged, which, in a similar way to the metal moldings illustrated above with reference to FIGS. 1 to 3, consists of a metal foam region 12, of a solid wall region 14 and of an insert element 16 arranged in the fringe region between these. The outer surface 20 of the core part, said outer surface corresponding at the same time to the inner surface of the outer wall body 34, is grooved or has another structure which makes a positive connection between the core part and the outer wall body 34. Since the outer wall body 34 shrinks onto the core part during casting, under certain circumstances a grooving of the surface 20 of the core part or of the interface between the core part and the outer wall body 34 may be dispensed with. In the production of the casting 30, first, the core part is produced and is then arranged and oriented in a mold which defines the outer configuration of the casting 30. In this mold, the outer wall body 34 is cast around the core part. A suitable choice of the temperatures of the core part, of the mold for the casting 30 and of the liquid material of the outer wall body 34 and/or the use of various metals with different melting temperatures for the core part and for the outer wall body 34 ensure that the core part does not melt again when being cast around.

In the exemplary embodiment illustrated in FIG. 3, therefore, a metal molding, such as was illustrated above with reference to FIGS. 1 and 2, serves as the lost core. Its size and arrangement define the wall thicknesses of the outer wall body 34. Furthermore, the metal foam region 12 supports the outer wall body and therefore increases the rigidity of the metal molding and absorbs solid-borne sound.

Figure 4:
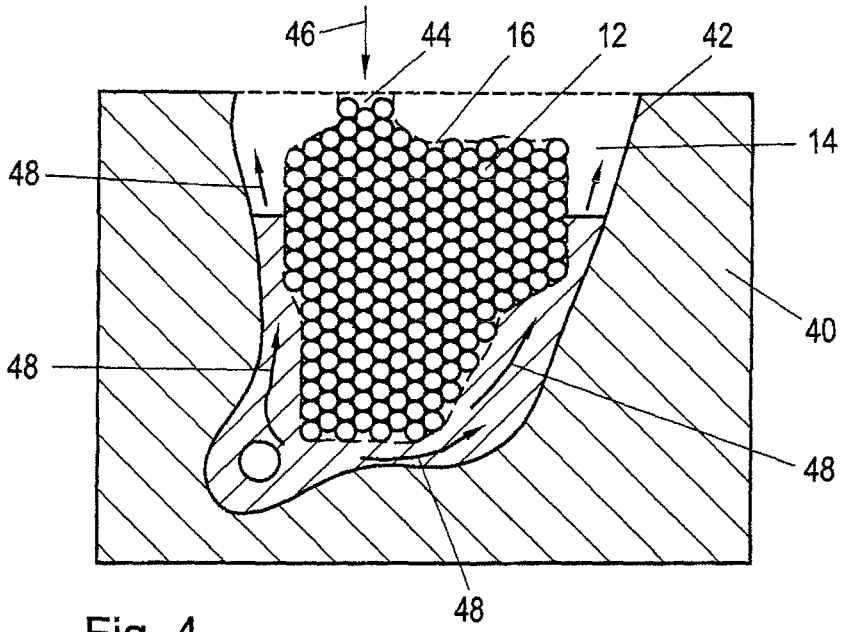
FIG. 4 shows a diagrammatic illustration of a casting operation in cross section.

FIG. 4 is a diagrammatic illustration of a cross section of a mold 40 in which a metal molding or core part 10, such as was illustrated above, for example, with reference to FIG. 1 or 2, is produced. The inner surface 42 of the mold 40, by virtue of its configuration, defines the form of the metal molding to be produced or the form of the surface of the metal molding. In the mold 40, an insert element 16 is arranged, such as has already likewise been described above with reference to FIGS. 1 to 3.

Flowable metal foam with a specific fraction of liquid metal is introduced through an orifice 44 of the insert part 16 into a metal foam region 12 defined by the insert element 16 (arrow 46). The metal foam fills the metal foam region 12. As already mentioned above, the insert element 16 has orifices or interspaces which are smaller than the gas bubbles of the flowable metal foam. This means, in particular, that, where elongate orifices or interspaces are concerned, at least the width of these is smaller or substantially smaller than the diameters of most (for example, 90 or 99%) of the gas bubbles. The gas bubbles or the flowable metal foam therefore cannot pass through the orifices or interspaces of the insert element 16.

Excess liquid metal, that is to say liquid metal which is not contained in webs of small or minimal thickness between two gas bubbles, penetrates through the orifices or interspaces of the insert element 16 and fills an interspace 14 between the insert element 16 and the inner surface 42 of the mold 40. The flow movement of the liquid metal through the insert element 16 and within the interspace 14 is indicated by arrows 48.

After the metal foam region 12 is filled completely with flowable metal foam and the interspace 14 is filled completely with liquid and essentially bubble-free metal, the mold 40 is cooled. After the metal foam in the metal foam region 12 and the metal in the interspace 14 have solidified, the mold 40 is opened or broken apart in order to remove the finished metal molding. For temperature control before the casting process and during cooling, the mold 40 preferably has heating and/or cooling elements which are not illustrated in FIG. 4.

Figure 5:
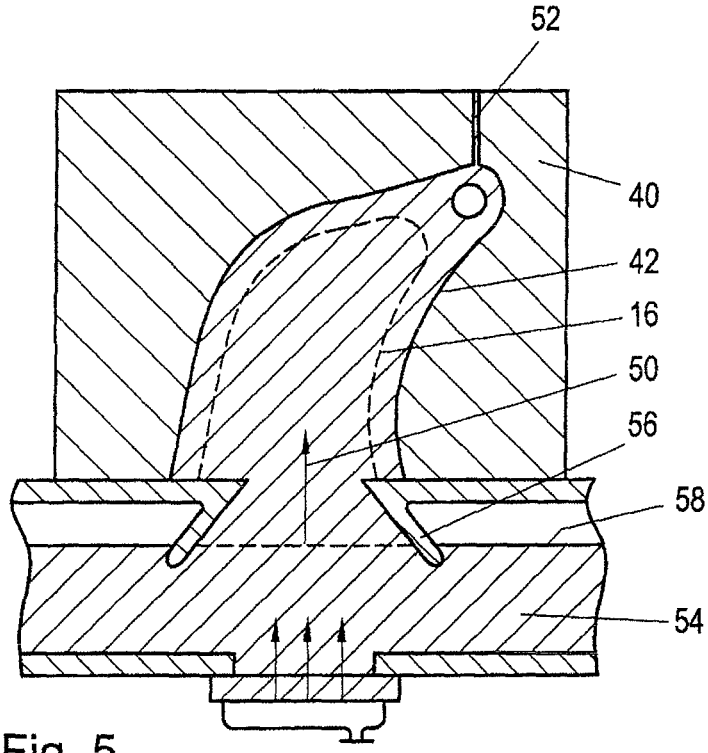
FIG. 5 shows a diagrammatic illustration of a casting operation in cross section.

Alternatively to the method illustrated above with reference to FIG. 4, the metal molding is produced, in a similar way to what is described in AT 411 970 B, by way of a casting mold or permanent mold 40 which, in addition to an infeed orifice 50, has at least one small-format orifice 52 in the vertically highest region, as illustrated in FIG. 5. The insert element 16 is arranged in the mold 40. The mold 40 is brought to and/or left at a temperature below the liquidus temperature or melting temperature of a foamable alloy. A cast-in or filling piece 56 which, on the one hand, projects into a melt 54 of this alloy is connected, on the other hand, to the mold 40 so as to seal off the liquid metal. By way of an upwardly directed movement of the meniscus or liquid metal level 58 of the melt through the infeed orifice 50 into the at least one small-format orifice 52, the air is displaced or discharged out of the mold 40.

In the melt 54, gas bubbles are formed and are combined into metal foam. This displaces the originally bubble-free or at least largely bubble-free melt 54 within the insert element 16. The bubbles are generated with a diameter which is larger than the orifices in the insert element 16 and therefore remain within the insert element 16. Between the insert element 16 and the inner wall of the mold, therefore, bubble-free or largely bubble-free melt 54 remains, in a layer thickness which is defined by the form of the inner wall of the mold 40 and by the form and arrangement of the insert element 16.

After the directed removal of heat, the metal foam and the melt solidify in the mold 40. Before this heat removal, the infeed orifice 50 of the mold 40 can be closed and the mold 40 can be separated from the cast-in or filling piece 56.

As already mentioned, the arrangement of the insert element 16 defines the configuration of the solid wall region 14. In particular, the distance of the insert element 16 from the surface 20 of the metal molding 10 determines the thickness of the solid wall region 14.

In a borderline case, the insert element 16 may be arranged directly on the surface 20 of the metal molding 10, the insert element 16 being, for example, a net or wire braiding. In this case, the solid wall region 14 comprises the orifices or interspaces of the insert element 16, in particular the interspaces between the wires of a wire braiding or net, into which no or only very few or very small gas bubbles penetrate.

By an appropriate arrangement and forming of one or more insert elements 16, solid regions with fewer or smaller or essentially no cavities may also be formed, which are not wall regions or are not contiguous to or are not contiguous over a large area to a surface 20 of the metal molding 10.

In addition to the insert element 16, the metal molding 10 may contain further inserts in the solid wall region 14 or in the metal foam region 12. Then, in contrast to the insert element 16, these inserts may not only serve for defining a fringe region between a metal foam region 12 and a solid wall region 14, but preferably also for strengthening or mechanical reinforcement and/or as ties or fastening elements for screwing, riveting, welding or otherwise connecting the metal molding 10 to other devices. For example, web-shaped or frame-shaped insert elements 16 may serve for improving or increasing the mechanical properties, in particular the strength (especially the tensile strength) and rigidity of the metal foam region 12 and consequently of the entire metal molding 10. Insofar as such an insert is arranged in the metal foam, it must be arranged such or be designed with sufficiently large orifices such that it does not prevent the metal foam region from being filled up completely with flowable metal foam.

Furthermore, insert elements may advantageously be used to define metal foam regions 12 with different properties of the metal foam, in particular with different bubble or pore sizes (see also FIG. 1*a*). As a result, for example, within a single metal molding 10, the energy absorption capability can thereby be modulated spatially (establishment of a plurality of energy absorption levels or plateau stresses). This is particularly advantageous, inter alia, in structural elements for crumple zones of automobiles or other vehicles, since it makes it possible to have an exact adaption to possible accident scenarios and occupant protection optimization.

Figure 6:
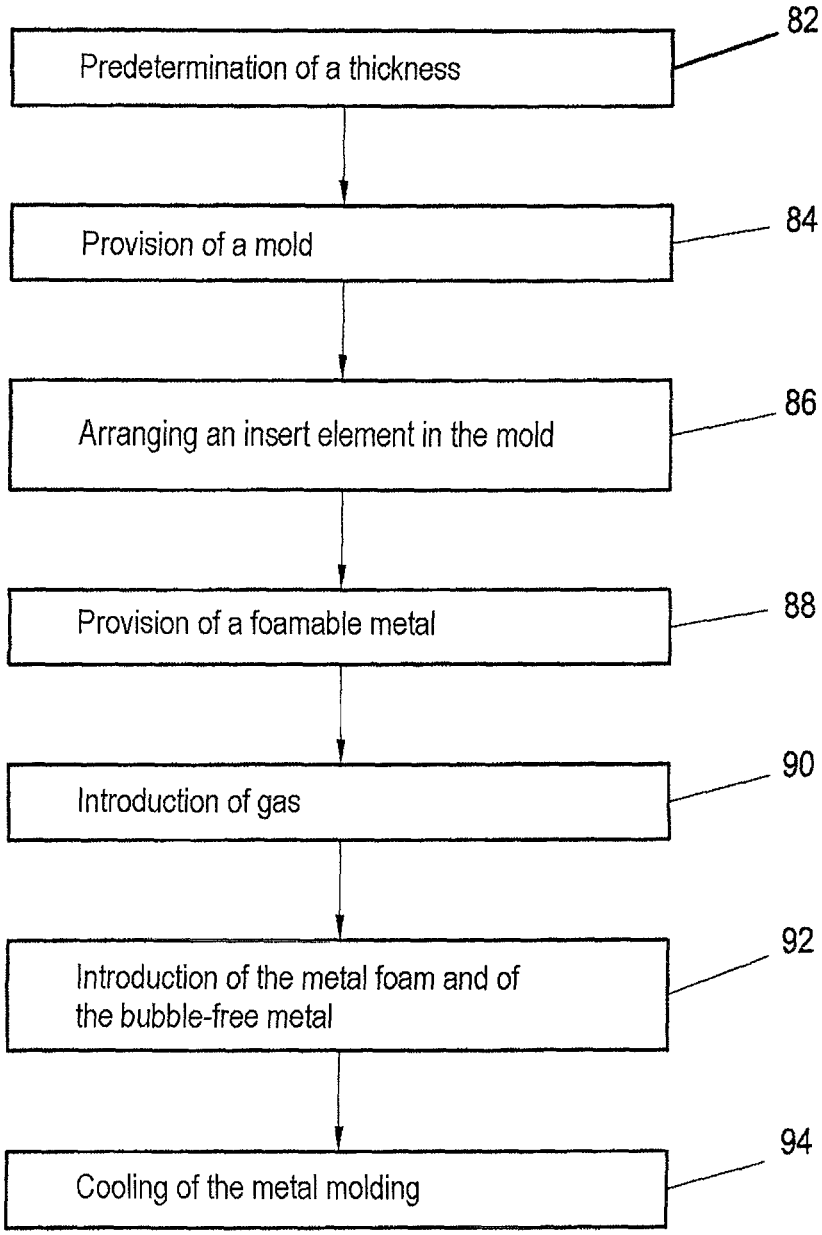
FIG. 6 shows a diagrammatic flowchart of a production method.

FIG. 6 is a diagrammatic flow chart of a method for producing a metal molding 10, such as was illustrated, for example, with reference to one of FIGS. 1 to 3. In a first step 82, a thickness of the solid wall region 14 or of another region, in which the metal molding 10 is to contain fewer or smaller or essentially no cavities, is determined. This takes place, for example, on the basis of the mechanical requirements which the metal molding 10 is to fulfill or on the basis of a material thickness which is necessary for further machining steps (milling, drilling, welding, etc.).

In a second step 84, a mold 40 is provided, the inner surface 42 of which defines the configuration of the outer surface 20 of the metal molding 10 to be produced. In a third step 86, an insert element 16 is arranged in the mold 40, is oriented and is fastened, for example, by way of clampings. The mold or at least its inner surface 42 is preferably preheated to a temperature near the melting temperature of the material used.

In a fourth step 88, a foamable metal is provided, for example in that a ready-made alloy is melted or is produced directly in the liquid state. The foamable metal preferably comprises composites with light metal, such as aluminum or magnesium. The melted metal may be mixed with particles which consist of a material having a melting point higher than the melting point of the metal (such as, for example, Sic or A1203). This particle serves particularly for stabilizing the metal foam subsequently generated. Details may be gathered from the patent literature mentioned initially.

In a fifth step 90, gas is introduced into the metal melt in order to generate gas bubbles or metal foam. In this case, the gas is introduced such that metal foam with an essentially monomodal distribution of the sizes of the gas bubbles or cavities is obtained. In the sixth step 92, the flowable metal foam is introduced into the metal foam region 12 and essentially bubble-free liquid metal is introduced into the future solid wall region 14. The fifth and sixth steps 90, 92 preferably take place, as described above with reference to FIGS. 4 and 5, and may in this case also be carried out in a different order.

In a seventh step 94, the mold 40 and the metal are cooled, so that the metal foam in the metal foam region 12 and the essentially bubble-free metal in the future solid wall region 14 solidify and form the metal molding 10.

The invention claimed is:

1. A metal molding comprising:

first and second regions metallically connected to one another;

the first region comprising a metal foam having a monomodal bubble size;

the second region comprising a metal;

at least one insert element made of a metal material having a higher melting point than a material of the metal foam and the metal, and being arranged between and adjacent the first and second regions, the at least one insert element having essentially the form of a sheet with through orifices extending between the first and second regions; and the through orifices comprising a cross section sized and configured to prevent passage of the monomodal foam bubbles of the first region from passing into the second region, whereby an area of the second region arranged adjacent the at least one insert element contains no foam bubbles.

2. The metal molding of claim 1, wherein the second region is a solid metal region arranged outside of the first region.

3. The metal molding of claim 1, wherein the at least one insert element comprises plural insert elements.

4. The metal molding of claim 1, wherein the at least one insert element comprises at least one of:

a net;

a lattice;

a perforated metal sheet;

a plurality of essential parallel bars;

a braided wire structure;

a web;

a strip;

a frame; and a portion of web, strip, or frame.

5. The metal molding of claim 1, wherein one of:

the material of the first region is an aluminum composite material and the material of the at least one insert element contains steel, aluminum, ceramic, carbon or glass in one of solid form and fiber; and the material of the second region is an aluminum composite material and the material of the at least one insert element contains steel, aluminum, ceramic, carbon or glass in one of solid form and fiber.

6. The metal molding of claim 1, wherein one of:

the metal molding comprises an outer contour and parts of at least a portion of the at least one insert element are spaced from the outer contour by an essentially identical distance; and the metal molding comprises an outer contour and the second region is arranged between the at least one insert element and the outer contour.

7. The metal molding of claim 1, wherein one of:

the second region has essentially no foam bubbles; and at least a portion of the second region has essentially a constant thickness.

8. The metal molding of claim 1, wherein the least one insert element separates the first region from a third region made of metal foam, and the first and third regions one of:

are different from one another in at least one property; and have different bubble size.

9. The metal molding of claim 1, wherein the least one insert element comprises another insert element separating the first region from a third region made of metal foam, and the first and third regions one of:

are different from one another in at least one property; and have different bubble size.

10. The metal molding of claim 1, wherein the least one insert element is structured and arranged to increase a mechanical strength or rigidity of the metal molding.

11. The metal molding of claim 1, wherein the at least one insert element is mechanically pre-stressed.

12. The metal molding of claim 1, wherein one of:

the material of the first region and of the at least one insert element have different coefficients of thermal expansion; and the at least one insert element is pre-stressed via one of:

a cooling of the metal molding;

post-production; and via different coefficients of thermal expansion.

13. A casting comprising:

a core part;

an outer wall body which at least partially surrounds the core part; and said core part comprising the metal molding of claim 1.

14. A molded part comprising:

first and second regions metallically connected to one another;

the first region comprising a metal foam having a monomodal bubble size;

the second region comprising a metal;

at least one insert element made of a metal material having a higher melting point than a material of the metal foam and the metal, and being arranged between and adjacent the first and second regions, the at least one insert element having essentially the form of a sheet with through orifices extending between the first and second regions; and the through orifices comprising a cross section sized and configured to prevent passage of the monomodal foam bubbles of the first region from passing into the second region.

15. The part of claim 14, wherein an area of the second region arranged adjacent the at least one insert element is a solid metal that contains no foam bubbles.

* * * * *